US007381105B2

(12) United States Patent
Miekka

(10) Patent No.: US 7,381,105 B2
(45) Date of Patent: Jun. 3, 2008

(54) ELECTRICAL CONTACT SURFACE HAVING NUMEROUS PROTRUSIONS

(75) Inventor: Fred Miekka, Arcadia, CA (US)

(73) Assignee: Sierra Madre Marketing Group, Arcadia, CA (US)

( * ) Notice: Subject to any disclaimer, the term of this patent is extended or adjusted under 35 U.S.C. 154(b) by 0 days.

(21) Appl. No.: 11/655,932

(22) Filed: Jan. 22, 2007

(65) Prior Publication Data

US 2007/0178777 A1 Aug. 2, 2007

Related U.S. Application Data

(60) Provisional application No. 60/764,084, filed on Feb. 1, 2006.

(51) Int. Cl.
*H01R 13/02* (2006.01)

(52) U.S. Cl. ..... 439/886; 439/931

(58) Field of Classification Search ..... 439/886, 439/887, 931

See application file for complete search history.

(56) References Cited

U.S. PATENT DOCUMENTS 3,713,080 A * 1/1973 Kennedy ..... 439/852
5,772,450 A * 6/1998 Bernardini ..... 439/67
5,973,405 A * 10/1999 Keukelaar et al. ..... 257/780

FOREIGN PATENT DOCUMENTS

RU 691939 * 10/1979

* cited by examiner

*Primary Examiner*—Renee S Luebke
*Assistant Examiner*—Vanessa Girardi
(74) *Attorney, Agent, or Firm*—Denis Khoo

(57) ABSTRACT

Electrical contacting surfaces are disclosed having numerous electrically conductive substantially spherical protrusions. These contacting surfaces may be used repeatedly in low voltage applications. The numerous electrically conductive substantially spherical protrusions provide points of high pressure thereby forming multiple parallel electrically conductive pathways across the contacting surfaces to establish good electrical continuity.

17 Claims, 9 Drawing Sheets

AMENDED
FIG. 17
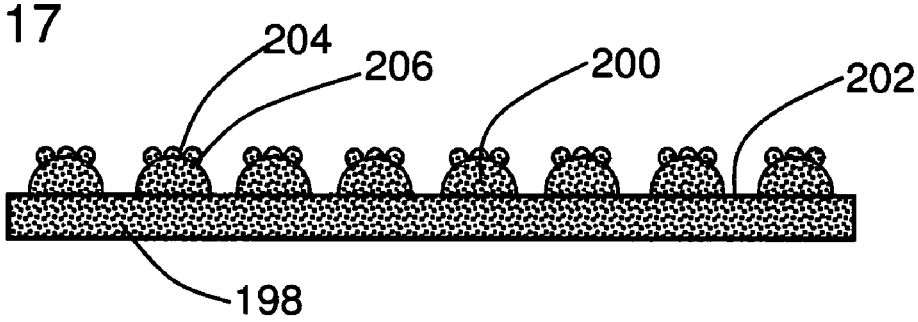
AMENDED

AMENDED
FIG. 20
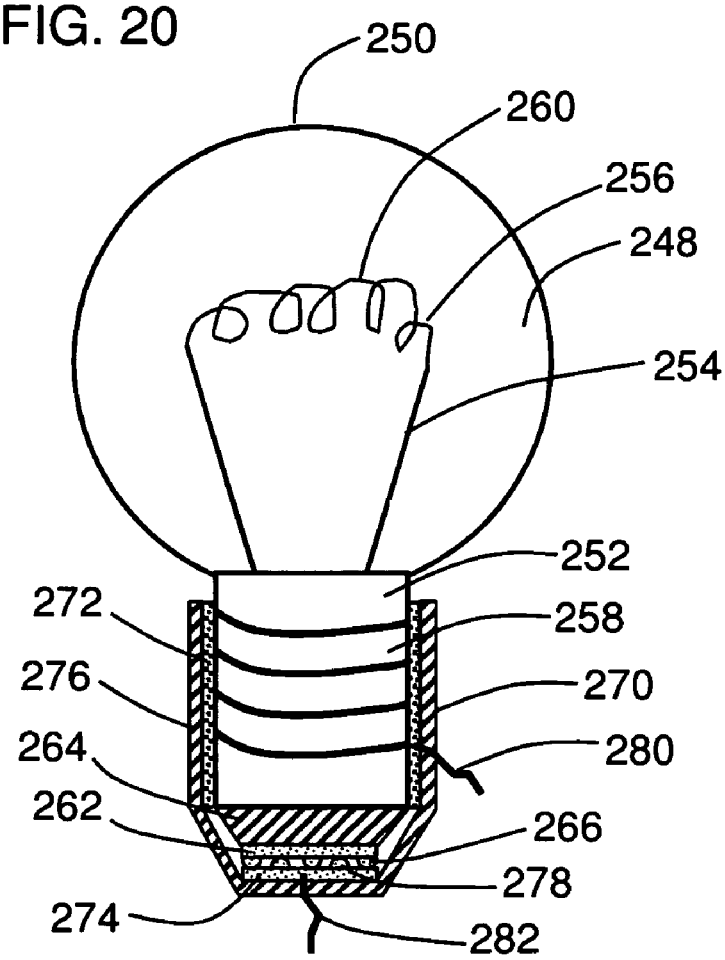

ELECTRICAL CONTACT SURFACE HAVING NUMEROUS PROTRUSIONS

CROSS-REFERENCE TO RELATED APPLICATIONS

This non-provisional application claims benefit of the provisional application filed on Feb. 1, 2006 having application number U.S. Ser. No. 60/764,084

BACKGROUND OF THE INVENTION

1. Field of the Invention

This invention relates to electrical contacting surfaces for low voltage and/or high current applications that may be connected and disconnected multiple times. The electrical contacting surfaces of the present invention employ numerous electrically conductive substantially spherical protrusions and may be used to establish multiple parallel electrically conductive pathways to other electrically conductive contacting surfaces.

2. Description of the Related Art

Electrical conductivity is a property common to many materials including metals. An electrically conductive material is a substance that allows the flow of electrical charge throughout its mass. Electrical charges come in many forms and may result from the separation of electrons from atoms. The separation of charge from atoms can render a substance electrically conductive if the charges are free to move. Although charged atoms can conduct electricity, in many cases it is the flow of electrons rather than charged atoms throughout a substance that is responsible for electrical conductivity.

Many of the elements in the periodic table are metals. Metallic elements such as copper are good conductors of electricity because they support the flow of electrons throughout their mass. This may result from loose electrons that are free to travel between atoms. Generally speaking all of the true metallic elements in the periodic table are capable of conducting electricity in this manner. Some elements such as silver and copper are good conductors of electricity while others such as lead tend to be significantly less conductive. It should be noted that the morphology of the metal itself may play a role in conductivity.

Generally speaking metals conduct electricity throughout their entire mass. When two or more pieces of metal are placed together good electrical contact between them may or may not occur. This depends on several factors including contact surface area, number of contacting points, surface contamination, contact pressure, and applied voltage.

Sliding electrical contactors are electrical contactors that have electrically conductive sliding surfaces that slide together. In many instances pressure is provided between the two contacting surfaces in order to improve conductivity. Examples of this include the following:

1. Wall outlets and matching plugs for providing power to household appliances.
2. Sliding connectors for connecting one set of wires to another.
3. Sliding contacts used to provide electrical connections to printed circuit boards.
4. Electric switches including knife switches and the like.

Wall outlets are sliding electrical contactors that are used to provide electric power to household electrical devices such as appliances. The outlets themselves are usually mounted flush to the surfaces of walls comprising the interior spaces of buildings. The flush mounting characteristics provide good aesthetic properties as well as significantly reducing the likelihood of damage resulting from inadvertently bumping into them. Many electrical outlets have two complete sets of electrical contactors. Each set of contactors having two relatively narrow slots with inner metal contacting surfaces along with a third and somewhat more circular hole having inner metal contacting surfaces as well. The inner metal contacting surfaces of the two relatively narrow slots are used to provide electric power to matching metal prongs found on the plugs of household electrical devices such as appliances. The inner metal contacting surfaces of the third somewhat more circular hole are used to provide an electric ground connection to the matching prong found on certain plugs that may be used to provide ground connections to household electrical devices such as appliances.

The two basic types of electric power are AC power and DC power. AC power (alternating current) continuously changes voltage with the voltage reversing itself at regular intervals over time. DC power (direct current) is steady with the voltage remaining constant over time.

The electric power provided to most standard household wall outlets is about 115 volts AC. This voltage represents the root mean squared voltage of a sixty cycle per second AC waveform. The peak voltage is usually about 170 volts (considerably higher than the root mean squared voltage). Because of this, household electrical outlets and any electrical devices that use this power require suitable electrical insulation properties that can safely withstand voltages in excess of 170.

Electrical grounding is provided because contact with 115 volts AC may result in serious bodily injury or even death. Electric shock occurs when a potential voltage exists across the body that is sufficient to carry a current disruptive to normal bodily functions. The nervous system of the human body is controlled by electrical impulses that may be considerably less than one milliampere (0.001 amperes). A potential of 115 volts AC is sufficient to carry several milliamperes across body parts under most conditions and may carry significantly greater currents through wet contacting surfaces. Once a disruptive current is established across the body, the individual may not be able to let go. In this case the current resulting from electric shock may be sufficient to completely overwhelm the nervous system.

Although an electric voltage potential must exist across the body in order to carry electric current, contact with only one electrically charged surface may result in electric shock. One reason for this has to do with electrical ground. An electrical ground such as the surface of the earth and conductive materials in contact with the surface of the earth represents an electrical connection that a voltage potential may be established across. If a metal electric appliance has an internal connection to its voltage source (from a bad wire or component) the entire outer conductive metal surface may acquire sufficient voltage with respect to ground to deliver an electric shock. This electric shock hazard may be reduced by connecting the metal conductive outer surface of the electric appliance to ground. A proper ground connection can prevent this hazardous condition thereby reducing the likelihood of electric shock.

Certain situations may arise in which a grounded electrical device may not be properly grounded. This condition can occur if the connection between the ground and the device is faulty. The sources of possible bad connections that lead up to this condition are numerous including a bad earth ground connection, faulty wiring, a bad connection between the outlet and plug, a faulty electrical cord, and a bad connection between the internal grounding wire of the electrical device and the device housing. Good electrical contact between the inner grounding wire and the housings of an electrical device may be achieved by placing a washer having numerous sharp edged cutting surfaces between the housing and internal grounding wire and tightening with a nut and bolt. The grounding washer is designed to cut into metal surfaces to establish good continuity. It is interesting to note that significant effort has been placed on providing a good ground connection between internal grounding wires and metal housings but not much effort has been placed on the grounding connection between the grounding prongs of plugs and the sliding electric contacting surfaces on the interior surfaces of outlets. One reason for this may have to do with the fact that the internal ground connection of metal housings is meant to be permanent and the plug connection is designed to be removable.

The 115 volts AC in use today results from several needs including the following:

1. The ability to change voltage by employing transformers.
2. The need to carry considerable power through relatively small diameter wires.
3. The need to provide electric lighting that does not flicker.
4. The need to keep voltages down to a "reasonable level"
5. The need to reduce arcing in switch contacts.
6. Sufficient voltage to overcome surface contamination between electrical contacting surfaces.

Transformers are devices that change AC voltages. A transformer consists of insulated copper wire wrapped around an iron core. When a voltage is applied across the wire, a magnetic field is established in accordance with the right hand rule of electrically induced magnetism. This magnetic field will rise and fall and reverse direction with each cycle of the AC waveform. This changing magnetic field may be conducted to a second copper insulated wire wrapped around the same iron core. A changing AC voltage is established in the second copper wire wrapping (coil) as a result of the changing magnetic field present in the iron core. The voltage ratio of the transformer is based on the ratio of turns between the two separate coils. In order to induce a current in an electrical conductor (such as a coil of wire) the magnetic field must be constantly changing. Because of this, transformers may be used to change the voltage of alternating current (AC). Direct current voltages are constant voltages that do not change. The application of direct current to a transformer results in resistive heating of the coil without any voltage output. Because of this, transformers may be used to change AC voltage but will not work with DC voltage.

The current carrying capacity of wires depends on the cross sectional diameter of their conductive metal center. Power in watts is represented by current in amperes times the applied voltage. The higher the voltage the more power a wire of any given conductive metal cross section can carry. Certain household appliances require over one thousand watts of power. Such appliances include hair dryers, air conditioners, electric ovens and stoves, and large microwave ovens. In order to provide this level of power without placing excessive current demands on electrical wiring, about 115 volts is required. If more than two thousand watts of power is required higher voltages may be employed.

AC electric power may be carried across long distances using high voltage utility lines and may pass through numerous transformers before being used to do useful work. With AC power, the higher the frequency, the greater the losses in transformers and transmission lines. Because of this, 60 cycles (a relatively low frequency) was chosen. It should be noted that below about 60 cycles, the flicker may be detectable in some electric light bulbs.

As mentioned above, contact with 115 volts AC may result in disruptive levels of current across body parts. Although somewhat hazardous, 115 volts AC may represent a reasonable compromise between safety and the need to carry useful quantities of power through relatively small wires. Below about 42 volts, difficulties arise in pushing enough current through intact skin to disrupt bodily functions. This arbitrary voltage has been chosen as being relatively "safe" in that contact with voltages below 42 rarely results in serious electric shock. It should be noted that exposure to sources of electric power below 42 volts under certain circumstances may still be harmful. For example, broken skin, wet conditions, and puncture wounds by electrically energized electrical components at or below 42 volts can still cause harmful electric currents to flow within the body.

Electric arcing represents one more reason why AC power is used instead of DC power. When a voltage is applied across a coil of wire, a magnetic field is established in accordance with the right hand rule of electrically induced magnetism. This electrically induced magnetic field represents stored energy. With DC electric power this field may build up to a high level and remain at that level until the power is disconnected. On disconnection of electric power (such as turning off a switch) the magnetic field will rapidly collapse. This often results in a large reverse voltage spike that may be sufficient to strike an arc across switch contacts. This arcing tends to damage electric switches and may even result in a hazardous condition if it becomes self sustaining. AC electric power has less tendency toward arcing in switch contacts when turning off inductive loads. This reduced tendency is due at least in part to the fact that the voltage is constantly rising and falling and reversing itself.

The tendency of surface contamination to inhibit the flow of current across two electrically conductive contacting surfaces is usually overcome by the 115 volt AC household power. While being sufficient in most cases with copper connections, it is not always sufficient to overcome electrically resistive contamination that may be found on aluminum wire.

Aluminum wire was previously used in some houses as a lower cost option to more expensive copper. Aluminum is low in cost, lightweight, and is a good conductor of electricity. Unfortunately, it tends to form non-conductive surface oxides on exposure to air. Once these oxides form, a point of high resistance may develop where the wire makes contact with its connection. In some instances this oxide layer may be sufficient to impede the flow of 115 volt AC current. A large voltage drop may occur across the contact surface resulting in local heating effects. Aluminum has a relatively high coefficient of thermal expansion. Numerous expansion and contraction cycles may loosen connections. Significant currents across loose connections coupled with oxide layers of high electrical resistance may produce sufficient heat to ignite the interior surfaces of buildings resulting in fire.

While aluminum and its associated oxide forming surface layers may provide difficulties in carrying 115 volt AC power across contacting surfaces, copper and various other metals often employed in conducting electric current across electrically conductive contacting surfaces tend to be more forgiving.

Numerous metals including copper may be used to conduct 115 volt AC electric current across contacting surfaces with little difficulty. Of further interest is the ability of copper and several other metals to efficiently carry electric current between contacting surfaces at or below 42 volts.

Many electrical contactors rely on significant applied voltages to overcome barriers to the flow of electrons across both contacting metal surfaces. Many electrical contactors provide good electrical conduction when operated at a value equal to or greater than about one hundred volts. Contactors may perform well at significantly lower voltages as well. Below about 20 volts difficulties may be encountered in copper and other metal contactors conducting electricity across contaminated surfaces. As in the case with aluminum, this may present special problems associated with the unwanted formation of heat at the point of contact while carrying high currents.

The more contact surface area, points of contact, pressure, and applied voltage, the better the electrical conductivity between the two surfaces. In many instances surface contamination involves non-conductive materials. Because of this, contamination between contacting metal surfaces may reduce conductivity between them. Keeping the area clean may help to improve contact conductivity but may prove difficult. Increasing the pressure between contacting pieces of metal may help to push contamination out of the way thereby improving conductivity between them. In addition, contact surface area and or the number of actual contact points may improve. It should be noted that for electrical contact to occur between two pieces of metal loose electrons from one piece of metal need to travel over to the atoms of the other and vice versa.

A specific example of this type of electric connection is the contact area between a car battery post and battery clamp. A poorly conducting metal (lead) is in an adverse environment (sulfuric acid, vibration, changing temperatures, and galvanic effects) to carry significant amounts of current (100 to 1,000 amperes) at a relatively low voltage 12 volts DC. Battery clamps used in vehicles employ significant pressure to improve conductivity between the clamp and battery post. Unfortunately despite this fact, poor electric continuity may exist between vehicle battery posts and their associated clamps.

Despite the need for high power during starting, automotive batteries are rated at 12 volts. This voltage may represent a compromise for the need to use higher voltages to reduce the current carrying demands of electrical wiring with the need to keep battery costs down. Higher voltage batteries require more series wired cells and therefore are more expensive to produce. In addition, the more cells connected in series the greater the chances of one of the series connected cells failing. It should be noted that a 42 volt system may be used without creating an unreasonable electric shock hazard.

In addition to the main battery connection, there are numerous electrical connectors located under the hood and throughout the entire vehicle. These connectors are used to connect numerous wires to other wires, fuse boxes, sensors, circuit boards and other components requiring electric power. The majority of electrical contacting surfaces employed in vehicles are of the spring loaded sliding type designed for only a few cycles of connection and disconnection. Twelve volt automotive electrical systems employing numerous spring loaded sliding electrical connectors exposed to heat cycling, vibration, and contaminants presents certain challenges to the automotive industry. Increasing this voltage to 42 may help to improve the overall reliability of automotive electrical systems.

There are numerous inductors (coils of wire wrapped around iron cores) that are employed in automotive electrical systems. Included in this group are starter motors, alternators, electric motors for fans, windows, and windshield wipers, horns, relays, speakers, induction coils, and solenoid door locks. All of these inductors are capable of creating back voltage spikes having values several times the initial applied voltage. While being somewhat damaging to switches and relay contacts, these voltage spikes may be especially problematic to semi-conductor components found in computer chips, power regulating circuitry, and control circuitry. Of particular concern is the generation of stray unclamped voltage spikes in the electrical systems of newer vehicles. When a conductor carries an electric current, a magnetic field is established with that current in accordance of the right hand rule of electrically induced magnetism. This magnetic field builds up to a fixed level and then remains at that level as long as the conductor carries the current. This magnetic field represents stored energy. If the current is discontinued in such a conductor, the resultant magnetic field rapidly collapses. The rate of field collapse is usually much faster than the rate of build up. This rapidly collapsing magnetic field creates a voltage spike in the opposite direction that is often several times the original input voltage. When current is interrupted to a conductor having significant inductance (such as an ignition coil or alternator electromagnet) large spikes can be generated that are more than capable of permanently destroying delicate semi-conductor components such as MOSFETs (metal oxide semi-conductor field effect transistors).

In order to reduce the likelihood of damage to semi-conductor automotive components, protecting circuitry is often added to absorb voltage spikes. Voltage clamping devices such as reverse wired diodes, Zener diodes, surge protectors, RC snubbers, and the like are often employed to protect sensitive semi-conductor components from harmful voltage spikes. Many of these voltage clamping devices are used to absorb voltage spikes from common sources.

Suppression of transient voltage spikes is well known art. The following references are relevant to electrical systems used in the automotive industry and are incorporated herein by reference.

1. Betten, John. "Clamping circuit tames automotive voltage transients." Automotive Design Line. 30 Aug. 2006. www.automotivedesignline.com.
2. Tyco Electronics. "Automotive Electronics Protection using a PolyZen Device." 2006. Page 1. www.circuit-protection.com
3. Littlefuse, Inc. "Voltage Suppression-Solutions Tech Brief." www.littlefuse.com
4. Dallas Semiconductors. "Integrated Voltage Limiters for Automotive Applications." Application Note 3895. 2005. www.maxim-ic.com.
5. Berger, Ivan. "Can You Trust Your Car?." Spectrum. www.spectrum.ieee.org/print/1419.
6. Kobe, Gerry. "The 42-Volt Revolution-Automotive Battery Increase." Gale Group 2002.

More detailed descriptions may be found in numerous books covering the fields of electronics and electrical engineering.

Voltage spikes generated from sources unanticipated by the designers may bypass voltage clamping devices and damage semi-conductor components. The resulting problem may be difficult to diagnose if the trouble causing voltage spikes are intermittent. Poor connections to inductive sources may produce intermittent stray voltage spikes not anticipated by designers that can damage semi-conductor components.

Today's trucks, automobiles, and SUV's rely more and more on solid state components for their efficient operation. As a result, it is important to establish good conductivity between the battery post and connector. Poor connections may result in stray voltages that can cause intermittent problems that can be difficult to troubleshoot and in some cases may damage circuit components.

With older vehicles it was standard procedure to disconnect the alternator from the battery while the engine was running as a means of testing the alternator. If the engine kept running, it was a sign that the alternator was working. If the engine stopped running it was a sign that the alternator was not working properly. Although in theory most vehicle alternators require excitation energy from the rotor coil to function, residual magnetism was often sufficient to maintain enough voltage output to keep the engine idling.

The above mentioned test procedure is generally not carried out with newer vehicles due to the possibility of stray voltage spikes damaging delicate semi-conductor circuit components.

It should be noted that an automotive battery is capable of absorbing and clamping voltage transients. An intermittent battery connection may therefore produce voltage spikes by breaking electrical connections to inductors (coils of wire on iron cores) but may also present issues with not being able to absorb spikes once they are generated from other sources. Of course much of this depends on the particular wiring configuration of the automobile.

With respect to battery connections in automobiles, the charging circuit is designed to keep the battery voltage during use at 13.8 volts. This is the value that has been generally accepted for maintaining proper charge on 12 volt lead acid batteries. Poor battery connections may interfere with feedback voltage detection and charging efficiency. This condition may result in an over charge condition or an under charge condition that can significantly reduce battery life.

One fortunate aspect of lead acid batteries is that they tend to be somewhat tolerant to having a slight overcharge or undercharge. Other rechargeable batteries commonly employed in consumer electronic devices are more sensitive. For example, Nickel metal hydride batteries do not tolerate overcharge. Overcharging these batteries may result in rapid loss of capacity and significantly shorten their useful life. Lithium ion rechargeable batteries are commonly used in portable electronic devices such as cellular telephones and lap top computers. These batteries are used because of their high energy density. One unfortunate aspect of lithium ion batteries involves overcharging. Lithium ion batteries employ lithium ions to transfer charge back and forth between a material that holds and releases them in their ionic state. Lithium ions are relatively inert and therefore pose little hazard. Lithium metal on the other hand is reactive and may explode or burst into flame on exposure to water and other substances. Once a lithium ion battery is fully charged, a slight increase in charging voltage may cause the lithium ions to gain electrons forming lithium metal. Once this happens, further charging may plate enough of this metal out on the negative electrode to puncture the separator causing an internal short circuit. Local heating from the internal short circuit may be sufficient to cause fire and expose lithium metal to ambient air. Once this occurs, the fire that results may be particularly troublesome owing to the fact that lithium metal reacts with water forming explosive hydrogen.

Because of the hazardous overcharge condition of lithium ion batteries, each individual cell within a battery pack may be provided with voltage limiting circuitry. The industry standard is to limit the charging voltage to below 4.2 volts per cell.

A bad battery connection that gives a false voltage reading or bad connections within charging circuitry for lithium ion batteries can therefore be particularly troubling owing to the hazards associated with their overcharge condition.

Below about 5 volts, small amounts of surface contamination may interfere with electric conductivity between two contacting pieces of metal. The application of significant pressure to the contacting area may help to remedy the situation.

The amount of surface contamination may be quite variable and is dependent on numerous parameters. For example, many common metals such as aluminum rapidly form thin oxide layers on exposure to air. These oxide layers tend to be rather thin at first and often self passivating. Self passivation of freshly exposed metal surfaces is the result of the newly formed oxide layer being somewhat impervious to oxygen thereby limiting the overall thickness. It should be noted that surface exposed metal atoms have less other atoms surrounding them and therefore may be in a more reactive state. Thin film self passivating oxide layers may be from a few atoms thick to a few hundred atoms thick. Such layers may present continuity issues at low voltages. In addition, it should be noted that connection and disconnection of electrically contacting surfaces under the conditions of load may further increase the formation of oxide films.

The consumer electronics industry includes numerous devices that operate at low voltages. For example, the logic circuitry used in computers and other electronic devices often operates at 5 volts. This may be due at least in part to the properties of semi-conductor junctions. Because of the low voltages employed, a significant portion of their electrical connections are soldered into place. Removable connections often employ high pressure sliding inert gold plated metal contact surfaces. Satisfactory results are obtained with these connectors because they only need to stand up to a few cycles of connection and removal.

Electrical contactors designed for numerous repeated cycles of connection and disconnection often employ two conductive surfaces that are pressed together. Spring force is often employed in switches and magnetic force is often employed in relays. Electrical contactors designed for a few repeated cycles of use often take the form of conductive pieces of metal that are designed to slide against each other employing the compression force of a spring. The spring providing this compression force is often one of the sliding contacting surfaces. An example of this type of contactor is the household outlet and pronged plug. Electrical contactors designed for single use or a very limited number of cycles often employ the squeezing together of conductive electrical contacting surfaces using screws, nuts, and bolts. The use of screws, nuts, and bolts provides an easy way of exerting very high compression forces between two electrically conductive contacting surfaces.

Low voltage electrical contacting surfaces employed in numerous switches, batteries, and applications may develop poor electric continuity over time. This may become especially problematic with repeated use. Particularly troublesome are the electrical contacting surfaces of individual cell batteries. When several cells are connected in series, numerous bad connections may result. It should be noted that single cell consumer batteries may employ a dimple on one or more contact surfaces. This dimple may be used to provide a single point of high pressure that may help to establish a good single point connection between the battery terminal and another electrically conductive contacting surface.

Despite numerous improvements there remains a need to provide electrical contacting surfaces for repeated use having good conductivity at low operating voltages.

It is an object of this invention to provide electrical contacting surfaces having good conductivity with other conductive surfaces at low voltages.

It is a further object of this invention to provide electrical contacting surfaces resistant to the effects of surface contamination.

It is a further object of this invention to provide electrical contacting surfaces suitable for use in adverse environments.

It is a further object of this invention to provide electrical contacting surfaces suitable for repeated use.

Finally it is an object of this invention to provide redundancy in electrical contact by employing conducting surfaces having numerous protrusions.

SUMMARY OF THE INVENTION

This invention therefore proposes electrical contacting surfaces made of metal or other electrically conductive material having numerous spherical protrusions extending outwardly. The resulting protrusions provide a plurality of parallel current carrying conductive pathways provided by high pressure points that resist the effects of surface contamination. Such surfaces may be prepared in a variety of ways and may involve plating, casting, forming, forging, and machining operations.

BRIEF DESCRIPTION OF THE DRAWINGS

FIG. 17 shows a cross sectional view of an electrically conductive metal surface having protrusions with a second outer layer of smaller protrusions that form a flat planar surface.

FIG. 20 shows a cross sectional view of a light bulb having an electrical contactor with numerous protrusions screwed into a socket having an electrical contactor with numerous protrusions.

DESCRIPTION OF THE INVENTION

Figure 1:
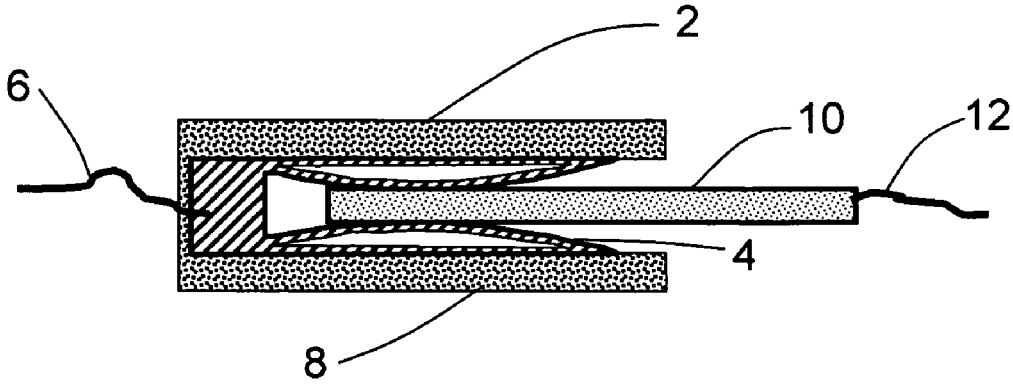
FIG. 1 Prior Art
FIG. 1 shows a cross sectional view of a sliding contactor of the prior art having smooth surfaces

FIG. 1 shows a cross sectional view of a sliding contactor of the prior art having smooth surfaces. FIG. 1 shows a typical sliding contactor of the prior art 2 comprised of a spring metal contact portion 4 connected to metal wire 6. Spring metal contact portion 4 is shown encased in electrically insulating plastic outer portion 8. Also shown is solid metal prong 10 and attached metal wire 12. Solid metal prong 10 is shown in contact with spring metal contact portion 4. When spring metal contact portion 4 is in contact with metal prong 10, continuous electrical continuity is established from wire 6 to wire 12.

The spring loaded sliding contactor shown in FIG. 1 is commonly employed in household outlets, connectors to electric circuit boards, and wire to wire connectors used in automotive wiring.

Figure 2:
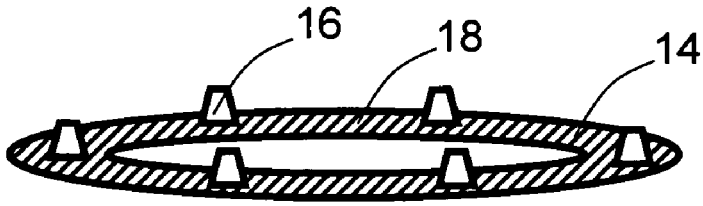
FIG. 2 Prior Art
FIG. 2 shows a star type washer for providing good grounding between an internal grounding wire and metal housing.

FIG. 2 shows a star type washer for providing good grounding between an internal grounding wire and metal housing. Hard metal grounding washer 14 is shown having numerous sharp protrusions 16 extending outwardly from surface portion 18. Numerous sharp protrusions 16 are designed to be pressed against inner metal surfaces of housings (not shown) using a grounding wire (not shown) and grounding screw (not shown) thereby cutting into the contacting metal surface establishing a good ground connection. This cutting action into the metal surface is a one time use application and often results in significant damage to numerous sharp protrusions 16 of metal grounding washer 14.

Figure 3:
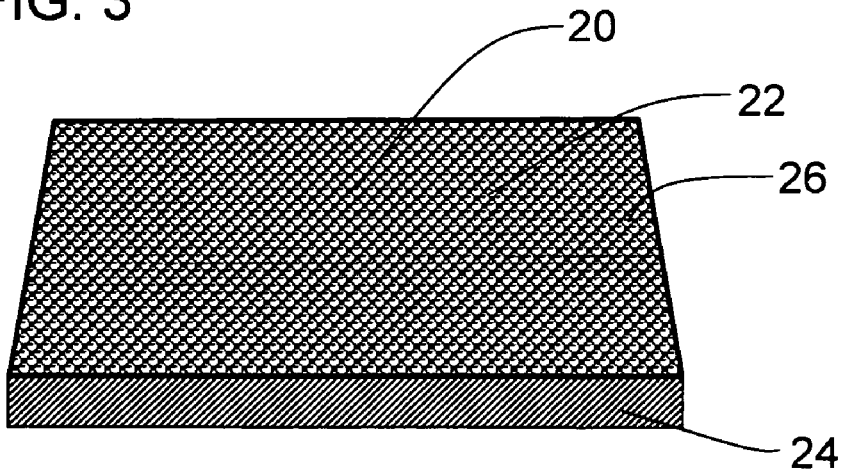
FIG. 3 shows an electrically conductive surface suitable for use in low voltage applications having numerous conductive protrusions.

FIG. 3 shows an electrically conductive surface suitable for use in low voltage applications having numerous conductive protrusions. Electrically conductive surface 20 consists of top portion 22 and bottom base portion 24. Top surface 22 consists of numerous substantially spherical electrically conductive protrusions 26 extending in an outward direction. Electrically conductive protrusions 26 are considered to be substantially spherical when their top exposed contacting surfaces are comprised of about 50% or more of a sphere. For example, electrically conductive protrusions 26 may take the form of cylinders having hemi-spherical top exposed contacting surfaces. Alternatively, electrically conductive protrusions 26 may be formed using the lost wax process thereby allowing for significant undercut and exposing more than 50 percent of spherical geometry. A good example of this can be found in U.S. Pat. No. 6,692,813 awarded to Allen Elder titled "Multilayer Spherical Bonding Construction". U.S. Pat. No. 6,692,813 discloses a bonding surface having numerous spherical protrusions. FIG. 2 of U.S. Pat. No. 6,692,813 shows an example of substantially spherical protrusions exposing more than 50% of spherical geometry. Electrically conductive surface 20 may be used to provide numerous contacting points of high pressure to other electrically conductive surfaces.

Sharp protrusions 16 of metal grounding washer 14 shown in FIG. 2, are designed for one time use and cut into metal surfaces. Numerous substantially spherical protrusions 26 on top surface 22 of electrically conductive surface 20 of FIG. 3 do not cut into metal surfaces but rather press against them. High pressure points develop where spherical electrically conductive protrusions 26 press against metal surfaces. This high pressure develops owing to the fact that spherical surfaces are curved and therefore tend to form one point of contact. Since this point of contact tends to be rather small, high pressure results. Additionally, spherical surfaces can take high compression loads without significant deformation. When numerous spherical protrusions are employed multiple points of contact are established between electrically conductive surface 20 and other electrically conductive surfaces (not shown). The result is an electrical contactor that may be used for multiple connection and disconnection cycles that establishes multiple parallel pathways of continuity between electrically conductive surface 20 and other electrically conductive surfaces (not shown).

Electrically conductive surface 20 of FIG. 3 may be prepared in numerous ways. Substantially spherical protrusions 26 of FIG. 3 may be formed by casting, electroforming, stamping, and other metal forming operations. These methods are well known and therefore will not be explained in further detail. It should be noted that casting and electroforming operations produce solid spherical protrusions and stamping and other metal forming operations produce substantially spherical protrusions that are less solid.

Figure 4:
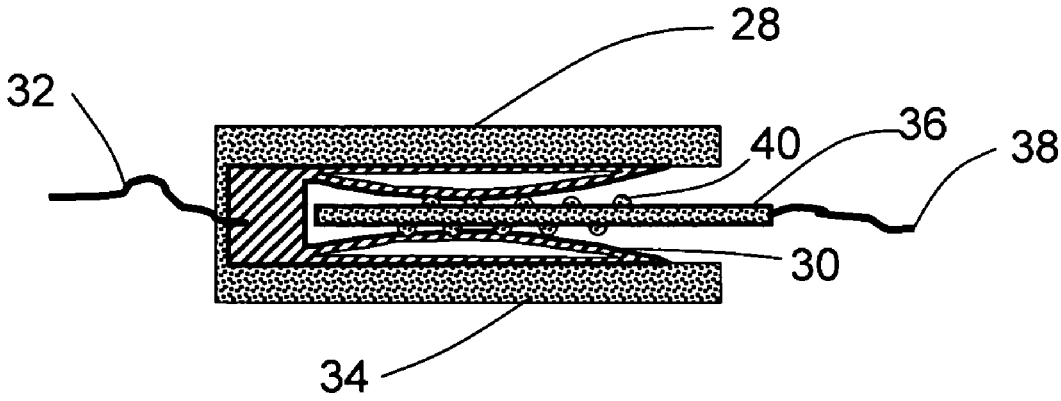
FIG. 4 shows a cross sectional view of a sliding contactor of the present invention having numerous protrusions

FIG. 4 shows a cross sectional view of a sliding electrical contactor of the present invention for multiple connection and disconnection cycles. Sliding contactor 28 is shown comprised of a spring metal contact portion 30 connected to metal wire 32. Spring metal contact portion 30 is shown encased in electrically insulating plastic outer portion 34. Sliding contactor 28 may be considered to be a receptacle in that it is a contacting device that receives and holds solid metal prong 36.

Also shown is solid metal prong 36 and attached metal wire 38. Solid metal prong 36 is shown having electrically conductive substantially spherical protrusions 40 in contact with spring metal contact portion 30. When spring metal contact portion 30 is in contact with electrically conductive substantially spherical protrusions 40 of metal prong 36, continuous electrical continuity is established from wire 32 to wire 38.

Electrically conductive first contacting surface 36 is shown having electrically conductive spherical protrusions 40 extending in an outward direction from first contacting surface 36. Spherical protrusions 40 extending in an outward direction from first contacting surface 36 are shown in electrical contact with spring metal contact portion 30 which may be considered to be a second electrically conductive contacting surface. Spring metal contact 30 is shown having sufficient compression spring properties to provide multiple parallel electrically conductive pathways to first electrically conductive contacting surface 36 thereby providing good electrical continuity between first electrically contacting surface 36 and second electrically conductive contacting surface 30 when slid together.

Figure 5:
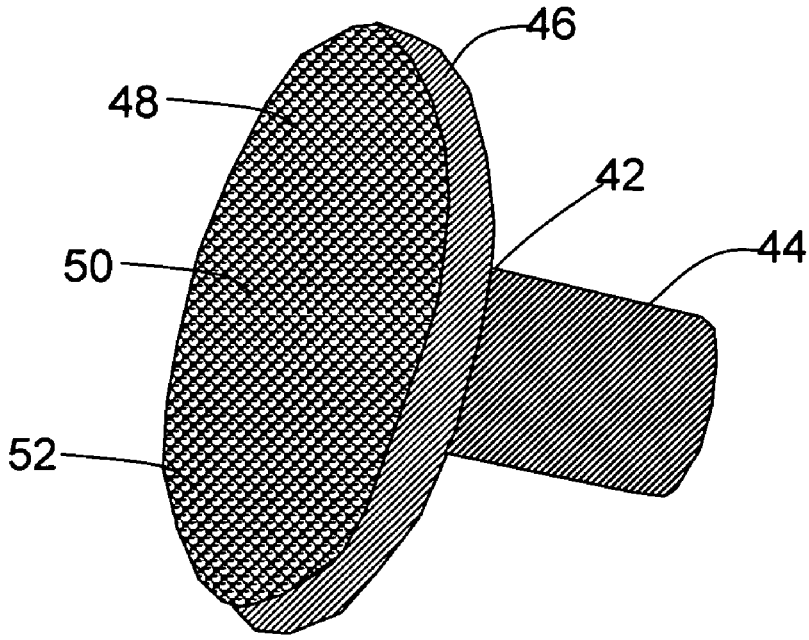
FIG. 5 shows a relay contactor having numerous conductive protrusions in accordance with the present invention.

FIG. 5 shows a relay contactor having numerous conductive protrusions in accordance with the present invention. Relay contactor 42 consists of connection portion 44 and base contact portion 46. Also shown is surface contact portion 48 having numerous protrusions 50 extending outwardly having spaces 52 in between.

Relay contactor 42 may be used to provide good low voltage electrical continuity to other contacting portions of relays. It should be noted that relays are a type of electrical switch and therefore relay contactor 42 may also be used in other forms of switching arrangements as well.

It should be noted that relay contactors provide electrical continuity between two electrically conductive contacting surfaces. An electromagnet provides sufficient force to bring both electrically conductive contacting surfaces together. An opposing spring is used to pull the electrically contacting surfaces apart when the electromagnet is shut off. This type of electrically conductive contacting surface arrangement provides two electrically conductive contacting surfaces that are pressed together in a stationary configuration without sliding.

Figure 6:
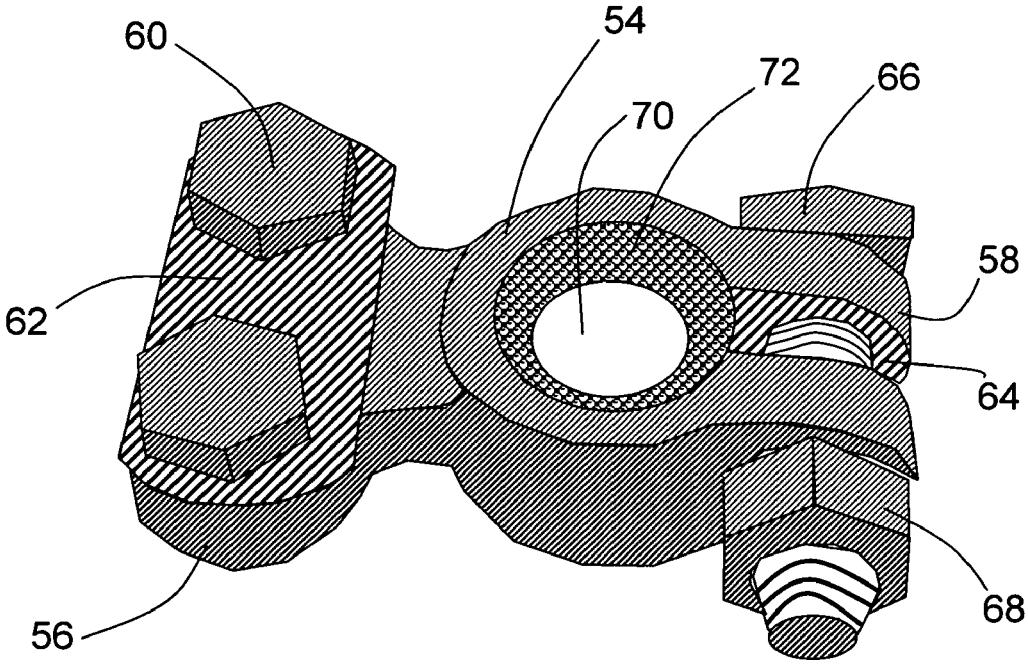
FIG. 6 shows a 12 volt battery clamp having numerous conductive protrusions along the inner contacting surface.

FIG. 6 shows a 12 volt battery clamp having numerous conductive protrusions along the inner contacting surface. Twelve volt vehicle battery clamp 54 is shown having cable clamping portion 56 and battery clamping portion 58. Cable clamping portion 56 consists of steel bolts 60 and steel plate 62. Bolts 60 are used to firmly press a battery cable (not shown) against the main portion of battery clamp 54. Cable clamping portion 56 may be used to firmly clamp a battery cable to battery clamp 54 thereby providing good electrical contact. Battery clamping portion 58 consists of squeezable space 64 along with bolt 66 and nut 68. Rotating nut 68 clockwise against bolt 66 reduces space 64 in battery clamp 54. Central hole 70 is shown having numerous surface protrusions 72 pointing inward in a radial direction. Reducing space 64 in battery clamp 54 reduces the diameter of central hole 70. This in turn places pressure against the battery post (not shown) thereby providing numerous points of good solid electrical contact. It should be noted that most vehicle battery posts consist of soft lead metal and therefore may undergo some deformation when using battery clamps employing the multi-protrusion electrically contacting surfaces of the present invention. Multiple disconnect and connection cycles may still be used by properly aligning the post to the clamp so that the protrusions in the clamp realign with any surface deformations present on the battery post.

Figure 7:
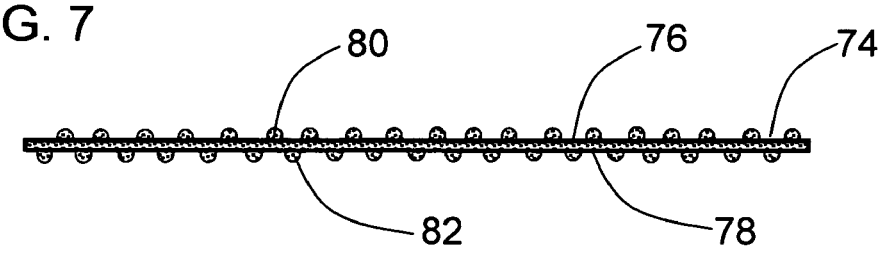
FIG. 7 shows a cross sectional view of an electrically conductive metal surface having protrusions on both sides that may be placed between electrically contacting surfaces in order to improve continuity.

FIG. 7 shows a cross sectional view of an electrically conductive metal surface having protrusions on both sides that may be placed between electrically contacting surfaces in order to improve continuity.

Electrically conductive construction 74 consists of top surface portion 76 and bottom surface portion 78. Top surface portion 76 consists of numerous substantially spherical electrically conductive protrusions 80 extending in an outward direction. Bottom surface portion 78 consists of numerous substantially spherical electrically conductive protrusions 82.

Electrically conductive construction 78 may be placed between two electrically conductive surfaces to improve electrical continuity from one surface over to the other. For example, a relatively thin form of electrically conductive construction 74 may be placed between a standard automotive battery post and clamp in order to provide numerous points of good electrical contact thereby providing multiple parallel electrically conductive pathways between the outer surface of the battery post and the inner surface of the battery clamp.

Figure 8:
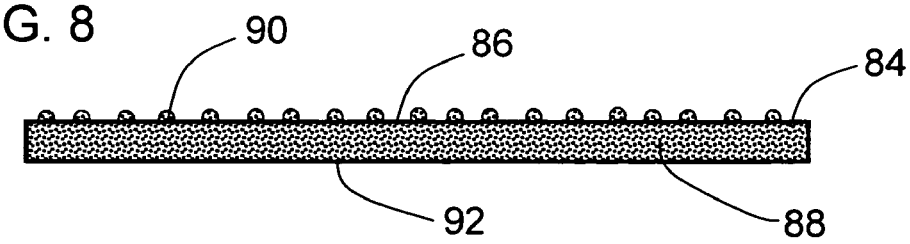
FIG. 8 shows a cross sectional view of a conductive copper metal sheet having protrusions on one surface that may be soldered to other electrical contacting surfaces to improve continuity.

FIG. 8 shows a cross sectional view of a conductive copper metal sheet having protrusions on one surface that may be soldered on the opposite surface to other electrical contacting surfaces to improve continuity. Electrically conductive construction 84 consists of top surface portion 86 and bottom base portion 88. Top surface 86 consists of numerous substantially spherical electrically conductive protrusions 90 extending in an outward direction. Bottom surface portion 92 of bottom base portion 88 may be made from an electrically conductive material such as copper that is receptive to liquid solder.

Electrically conductive construction 84 may be attached to other electrically conductive surfaces in order to produce an electrical contactor having a plurality of substantially spherical electrically conductive protrusions. The result is an electrical contactor suitable for multiple connection and disconnection cycles having electrically conductive spherical protrusions extending in an outward direction so that contact with a second electrically conductive surface under compression provides multiple parallel electrically conductive pathways between them.

Figure 9:
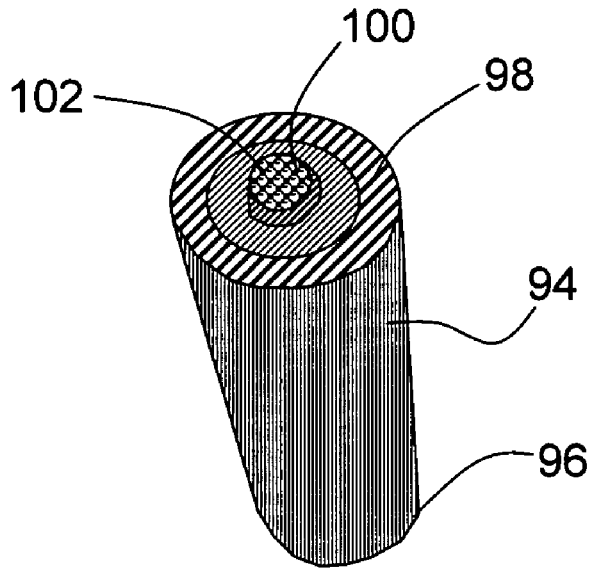
FIG. 9 shows a low voltage single cell consumer battery having a positive contact with numerous conductive protrusions.

FIG. 9 shows a low voltage single cell consumer battery having a positive contact with numerous conductive protrusions. Single cell battery 94 is shown having bottom portion 96 and top portion 98. Top battery contact 100 is also shown. Numerous electrically conductive protrusions 102 extend from contact 100 to provide good electrical continuity with other conductive surfaces. In particular, to provide multiple parallel electrically conductive pathways to other electrically conductive surfaces upon the application of pressure.

Figure 10:
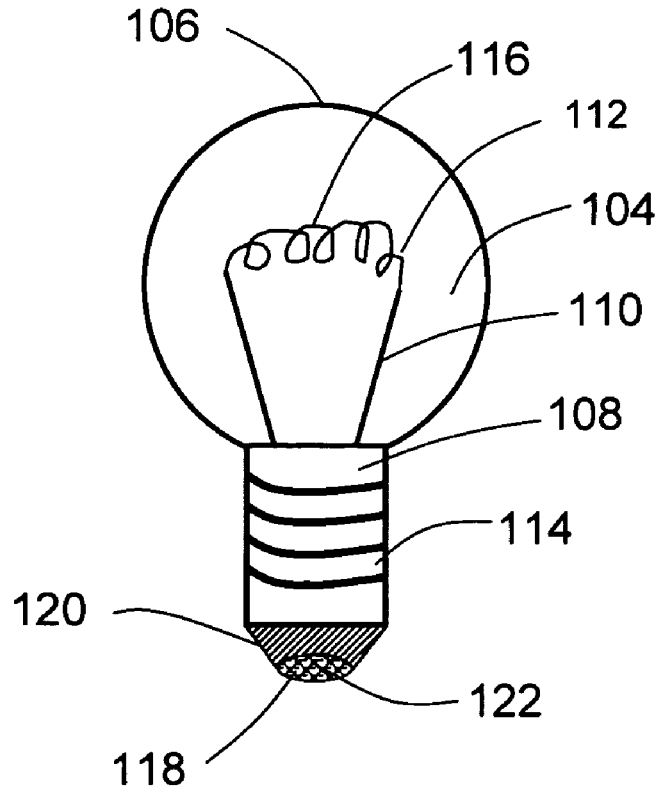
FIG. 10 shows an incandescent light bulb having numerous conductive protrusions at the base contact.

FIG. 10 shows an incandescent light bulb having numerous conductive protrusions at the base contact. Light bulb 104 is shown having glass bulb portion 106 and base portion 108. Also shown is filament portion 112 consisting of rigid wires 110 and filament 116. Bottom portion 108 consists of threaded electric contact 114 and bottom electric contact 118 separated from each other by glass insulating spacer 120. Bottom electric contact 118 is shown having numerous electrically conductive substantially spherical protrusions 122.

Electrically conductive substantially spherical protrusions 122 may be used to improve electrical contact with other conductive surfaces. This may prove to be particularly useful in low voltage applications involving environmental stresses such as flashlights. Numerous electrically conductive substantially spherical protrusions 122 extend from contact 118 to provide good electrical continuity with other conductive surfaces. In particular electrically conductive substantially spherical protrusions 122 provide multiple parallel electrically conductive pathways to other electrically conductive surfaces upon the application of rotary sliding pressure. Rotary sliding pressure in this instance refers to two surfaces rotating against each other under a compressive load. The rotation of the light bulb into a socket (not shown) provides rotary sliding action and the pressure provided by screwing the bulb into a socket provides the compressive load. This compressive load occurs between electrically conductive substantially spherical protrusions 122 and their contacting surface in the light bulb socket (not shown).

Figure 11:
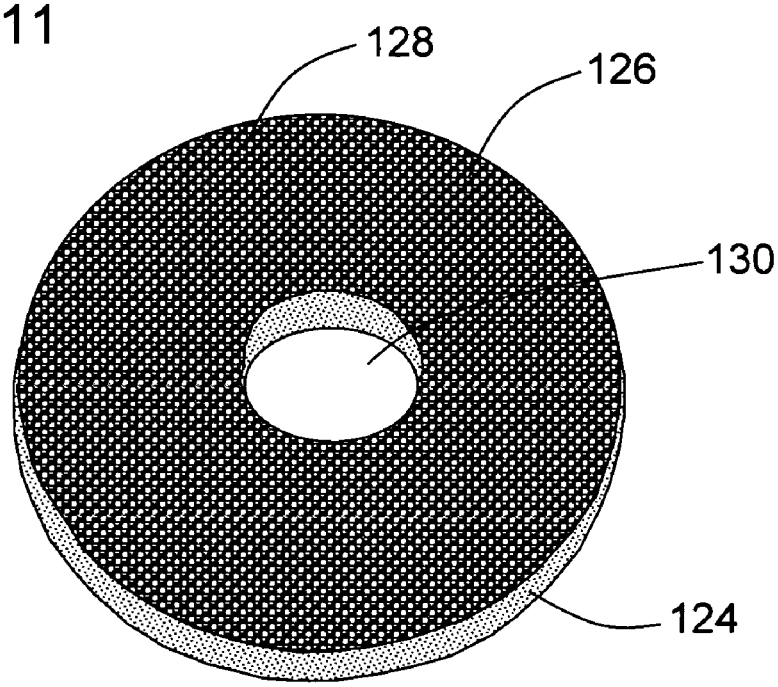
FIG. 11 shows an electrically conductive multi-protrusion contacting element for improving the continuity between a battery post and clamp.

FIG. 11 shows an electrically conductive multi-protrusion contacting element for improving the continuity between a battery post and clamp. Contacting element 124 is shown having a top contacting surface 126 having numerous electrically conductive substantially spherical protrusions 128 extending outwardly from the surface of contacting element 124. Also shown is central hole 130 which is suitable for mounting connector 124 to the top portion of a battery post and clamp using a bolt (not shown). Connector 124 may be made of a suitable material having sufficient strength to allow significant compression force to be applied by a bolt to provide multiple parallel electrically conductive pathways to other electrically conductive surfaces upon the application of pressure. Alternatively, a softer material may be used in combination with a rigid washer (not shown).

Connector 124 of FIG. 11 may be added on to existing automotive batteries in order to provide additional contact area between battery posts and clamps. A hole may be drilled down the top center of the battery post. This hole may then be threaded using a tap. Alternatively, a threaded post may be cast into the top of the battery post itself.

Figure 12:
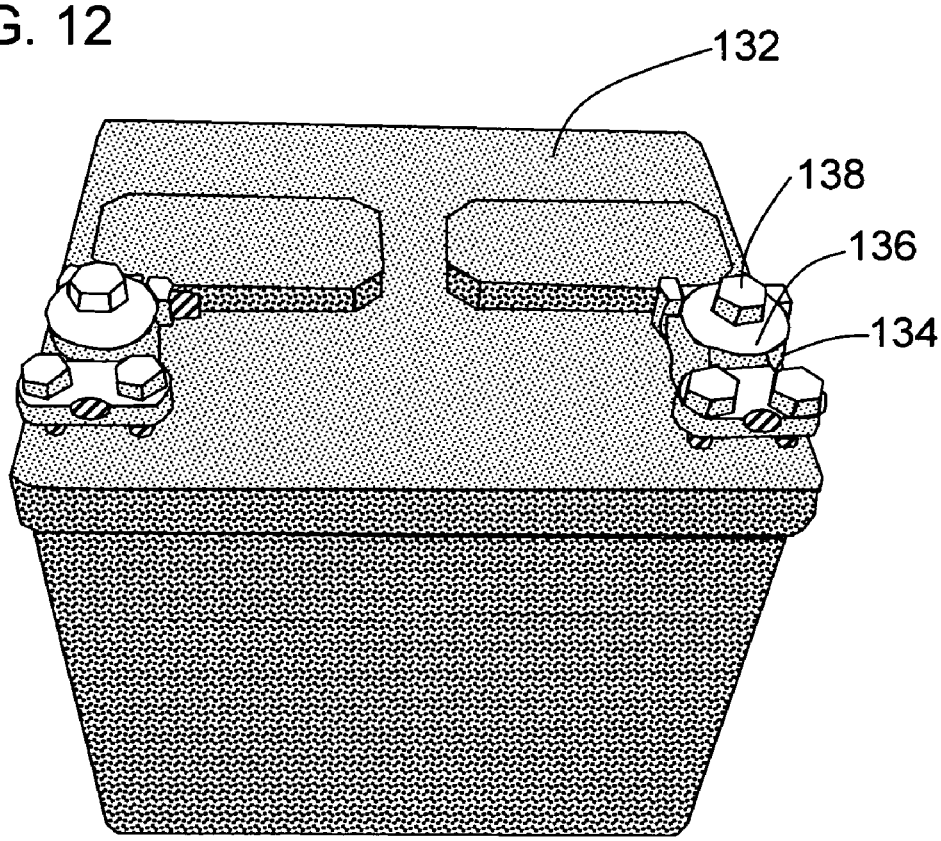
FIG. 12 shows an automotive battery having a traditional clamp along with the added contacting element of FIG. 11.

FIG. 12 shows an automotive battery having a traditional clamp along with the added contacting element of FIG. 11.

Automotive battery 132 is shown having standard battery clamps 134 firmly attached to standard battery posts (not shown). Also shown are added electrically conductive multi-protrusion contacting elements 136. Bolts 138 are threaded into the top portions of the battery posts (not shown). Bolts 138 provide sufficient compression force to contacting elements 136 to simultaneously provide multiple parallel electrically conductive pathways to the top surfaces of both the battery post and clamp. The added conductive pathways provided by multi-protrusion contacting elements 136 may be used to reduce overall contact resistance between battery posts and connectors in automotive applications.

Figure 13:
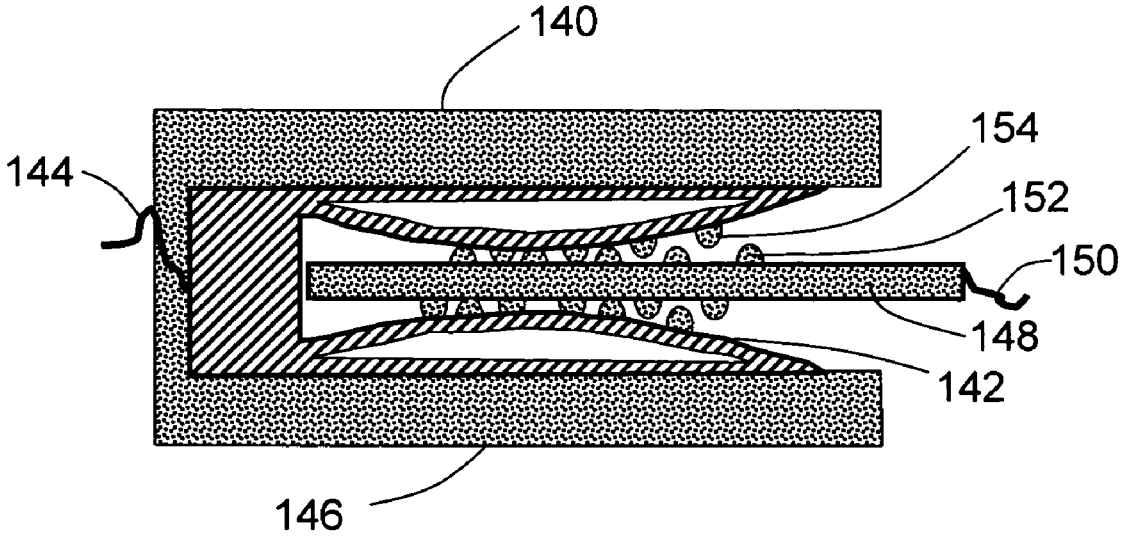
FIG. 13 shows a cross sectional view of a sliding contactor of the present invention having numerous protrusions having added interlocking protrusions on the second contacting surface.

FIG. 13 shows a cross sectional view of a sliding contactor of the present invention for multiple connection and disconnection cycles having added interlocking protrusions on the second contacting surface.

Sliding contactor 140 is shown comprised of a spring metal contact portion 142 connected to metal wire 144. Spring metal contact portion 142 is shown encased in electrically insulating plastic outer portion 146. Sliding contactor 140 may be considered to be a receptacle in that it is a contacting device that receives and holds solid metal prong 148. Also shown is solid metal prong 148 and attached metal wire 150. Solid metal prong 148 is shown having substantially spherical protrusions 152 in contact with spring metal contact portion 142. Also shown are electrically conductive substantially spherical protrusions 154 extending in an outward direction from spring metal contact portion 142. Electrically conductive substantially spherical protrusions 154 extending in an outward direction from spring metal contact portion 142 are shown interlocking with electrically conductive substantially spherical protrusions 152 on solid metal prong 148. When spring metal contact portion 142 is in contact with substantially spherical protrusions 152 of metal prong 148, continuous electrical continuity is established from wire 144 to wire 150.

Electrically conductive first contacting surface 148 is shown having electrically conductive substantially spherical protrusions 152 extending in an outward direction from first contacting surface 148. Electrically conductive substantially spherical protrusions 152 extending in an outward direction from first contacting surface 148 are shown in electrical contact with spring metal contact portion 142 which may be considered to be a second electrically conductive contacting surface. Spring metal contact 142 is shown having sufficient compression spring properties to provide multiple parallel electrically conductive pathways to first electrically conductive contacting surface 148 thereby providing good electrical continuity between first electrically contacting surface 148 and second electrically conductive contacting surface 142.

Figure 14:
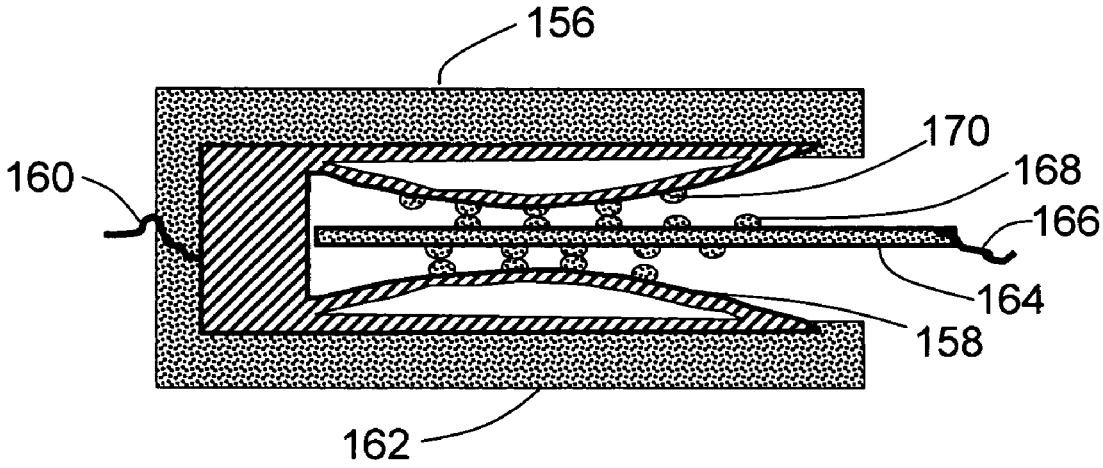
FIG. 14 shows a cross sectional view of a sliding contactor of the present invention having numerous protrusions on both contacting surfaces that are in alignment and in electrical contact with each other.

FIG. 14 shows a cross sectional view of a sliding contactor of the present invention having numerous protrusions on both contacting surfaces that are in alignment and in electrical contact with each other.

Sliding contactor 156 is shown comprised of a spring metal contact portion 158 connected to metal wire 160. Spring metal contact portion 158 is shown encased in electrically insulating plastic outer portion 162. Sliding contactor 156 may be considered to be a receptacle in that it is a contacting device that receives and holds solid metal prong 164. Also shown is solid metal prong 164 and attached metal wire 166. Solid metal prong 164 is shown having electrically conductive substantially spherical protrusions 168 extending in an outward direction. Electrically conductive substantially spherical protrusions 168 extending in an outward direction from metal prong 164 are in contact with spherical protrusions 170 extending in an outward direction from spring metal contact portion 158. When electrically conductive substantially spherical protrusions 170 extending in an outward direction from spring metal contact portion 158 are in contact with substantially spherical protrusions 168 of metal prong 164, multiple parallel electrically conductive pathways are established between spring metal contact portion 158 and solid metal prong 164. The parallel electrically conductive pathways that are established between spring metal contact portion 158 and solid metal prong 164 provides continuous electrical continuity from wire 160 to wire 166.

Figure 15:
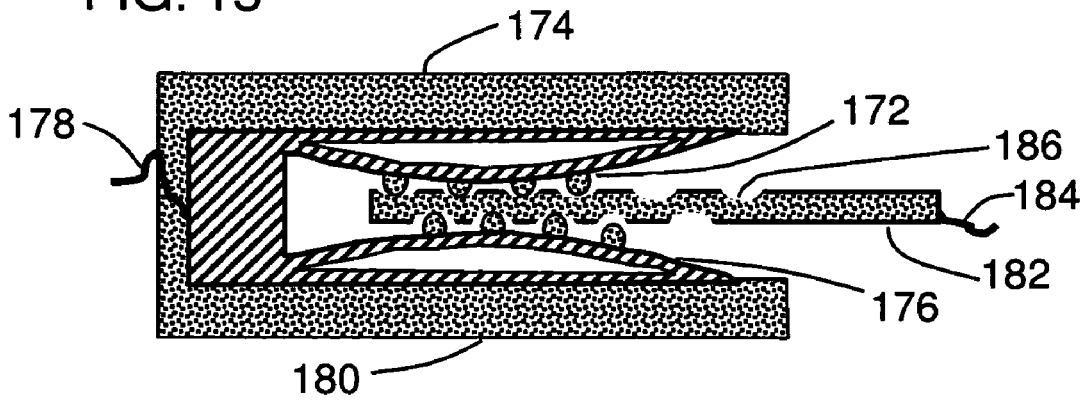
FIG. 15 shows a cross sectional view of a sliding contactor of the present invention having numerous protrusions on one contacting surface in contact alignment with concavities in the other contact surface.

FIG. 15 shows a cross sectional view of a sliding contactor of the present invention having numerous protrusions on one contacting surface in contact alignment with concavities in the other contact surface. Sliding contactor 174 is shown comprised of a spring metal contact portion 176 connected to metal wire 178. Spring metal contact portion 176 is shown encased in electrically insulating plastic outer portion 180. Sliding contactor 174 may be considered to be a receptacle in that it is a contacting device that receives and holds solid metal prong 182. Also shown is solid metal prong 182 and attached metal wire 184. Solid metal prong 182 is shown having electrically conductive matching concavities 186 in contact with electrically conductive substantially spherical protrusions 172 extending in an outward direction from spring metal contact portion 176. Electrically conductive substantially spherical protrusions 172 extending in an outward direction from spring metal contact portion 176 are shown in contact alignment with electrically conductive matching concavities 186 on solid metal prong 182. When spring metal contact portion 142 is in contact with substantially spherical protrusions 152 of metal prong 148, continuous electrical continuity is established from wire 144 to wire 150.

Figure 16:
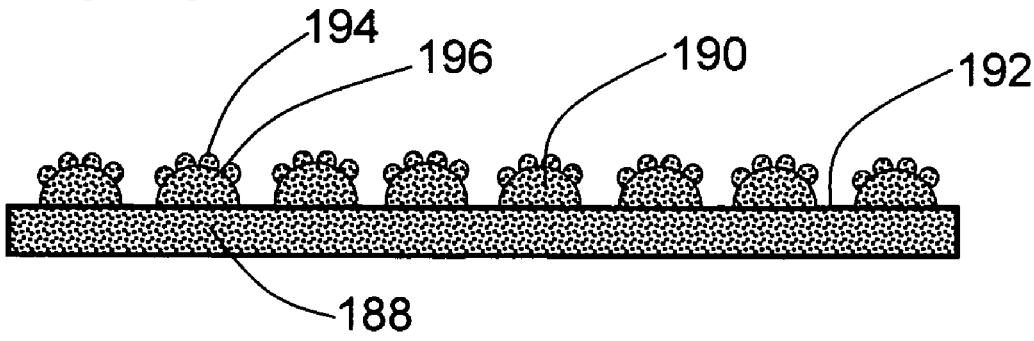
FIG. 16 shows a cross sectional view of an electrically conductive metal surface having protrusions with a second outer layer of smaller protrusions.

FIG. 16 shows a cross sectional view of an electrically conductive metal surface having protrusions with a second outer layer of smaller protrusions. Electrically conductive metal surface 188 is shown having numerous electrically conductive substantially spherically protrusions 190 extending in an outward direction from top surface portion 192 of electrical contactor 188. Also shown are smaller electrically conductive substantially spherical protrusions 194 extending in an outward direction from top portions 196 of electrically conductive substantially spherical protrusions 190.

The above described electrically conductive metal surface may be used to provide numerous high pressure points from each protrusion 190. Electrically conductive metal surface 188 may be used as the electrical contacting surface in numerous applications. For example, the sliding electrical contactors of claim 1 may employ this surface to provide more individual points of high pressure to other electrically conductive contacting surfaces thereby establishing a greater number of parallel electrically conductive pathways between both surfaces.

FIG. 17 shows a cross sectional view of an electrically conductive metal surface having protrusions with a second outer layer of smaller protrusions that form a flat planar surface. Electrically conductive metal surface 198 is shown having numerous electrically conductive substantially spherically protrusions 200 extending in an outward direction from top surface portion 202 of electrical contactor 198. Also shown are smaller electrically conductive substantially spherical protrusions 204 extending in an outward direction from top portions 206 of electrically conductive substantially spherical protrusions 200.

The above described electrically conductive metal surface may be used to provide numerous high pressure points from each protrusion 200. Electrically conductive metal surface 198 may be used as the electrical contacting surface in numerous applications. For example, the sliding electrical contactors of claim 1 may employ this surface to provide more individual points of high pressure to other electrically conductive contacting surfaces thereby establishing a greater number of parallel electrically conductive pathways between both surfaces.

Smaller electrically conductive substantially spherical protrusions 204 form flat planar surfaces that extending in an outward direction from top portions 206 of electrically conductive substantially spherical protrusions 200. The flat planar surface geometry formed of smaller electrically conductive substantially spherical protrusions 204 may be used to establish multiple parallel electrically conductive pathways to flat electrically conductive contacting surfaces (not shown).

Figure 18:
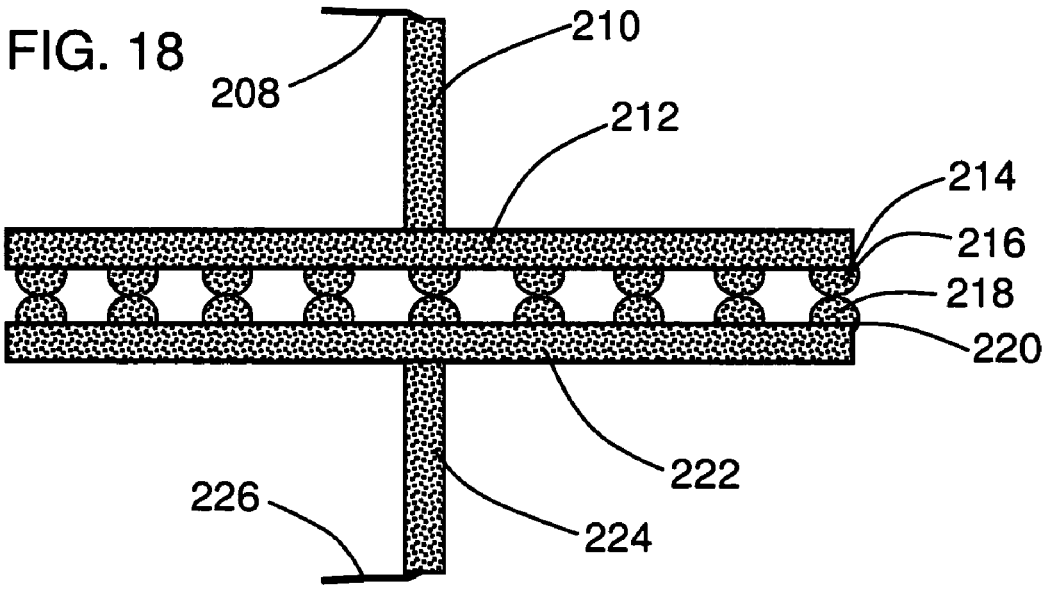
FIG. 18 shows a cross sectional view of an electrical contactor having two contacting surfaces each having protrusions in contact with the protrusions of the other contacting surface.

FIG. 18 shows a cross sectional view of an electrical contactor having two contacting surfaces each having protrusions in contact with the protrusions of the other contacting surface. Electrical contactor 212 is shown having a plurality of electrically conductive substantially spherical protrusions 216 extending in an outward direction from surface 214 of electrical contactor 212. Also shown is connection portion 210. Wire 208 is used to provide power to connection portion 210 of electrical contactor 212. Also shown is electrical contactor 222. Electrical contactor 222 is shown having a plurality of electrically conductive substantially spherical protrusions 218 extending in an outward direction from surface 220 of electrical contactor 222. Also shown is connection portion 224. Wire 226 is used to provide power to connection portion 210 of electrical contactor 222. Electrically conductive substantially spherical protrusions 216 of electrical contactor 212 are shown in contact with electrically conductive substantially spherical protrusions 218 of electrical contactor 222 thereby establishing multiple parallel electrically conductive pathways between electrical contactor 212 and electrical contactor 222.

Figure 19:
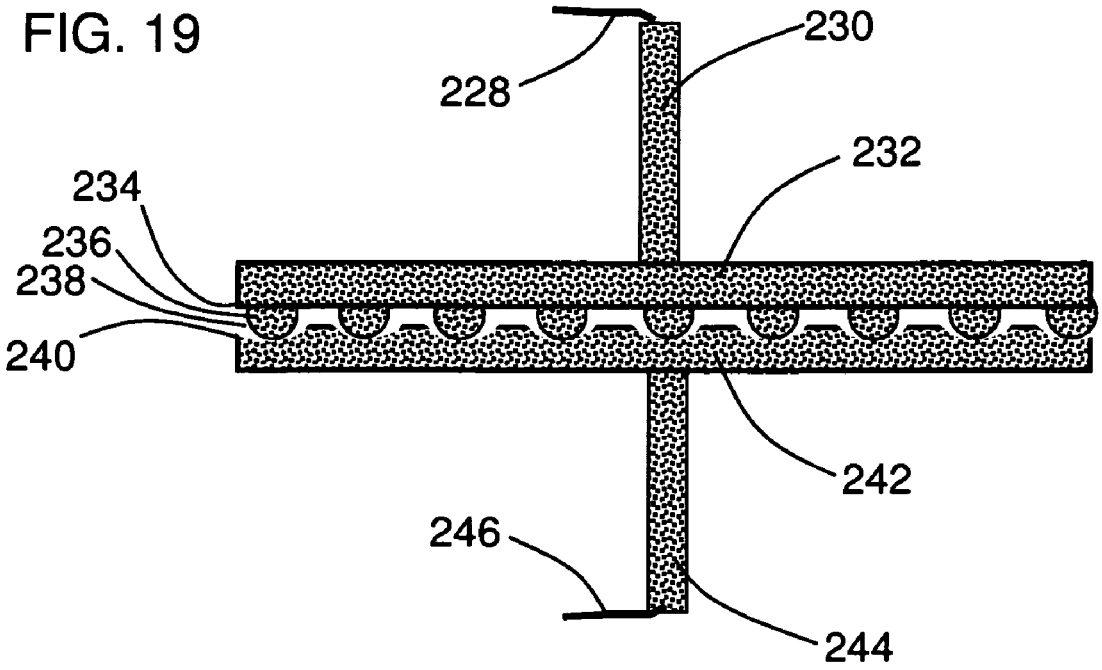
FIG. 19 shows a cross sectional view of an electrical contactor having two contacting surfaces, one contacting surface having protrusions and the other contacting surface having concavities that are aligned to the protrusions of the other contacting surface.

FIG. 19 shows a cross sectional view of an electrical contactor having two contacting surfaces, one contacting surface having protrusions and the other contacting surface having concavities that are aligned to the protrusions of the other contacting surface. Electrical contactor 232 is shown having a plurality of electrically conductive substantially spherical protrusions 236 extending in an outward direction from surface 234 of electrical contactor 232. Also shown is connection portion 230. Wire 228 is used to provide power to connection portion 230 of electrical contactor 232. Also shown is electrical contactor 242. Electrical contactor 242 is shown having a plurality of electrically conductive matching concavities 238 in surface 240 of electrical contactor 242. Also shown is connection portion 244. Wire 246 is used to provide power to connection portion 230 of electrical contactor 242. Electrically conductive substantially spherical protrusions 236 of electrical contactor 232 are shown in contact with electrically conductive matching concavities 238 of electrical contactor 242 thereby establishing multiple parallel electrically conductive pathways between electrical contactor 232 and electrical contactor 242.

FIG. 20 shows a cross sectional view of a light bulb having an electrical contactor with numerous protrusions screwed into a socket having an electrical contactor with numerous protrusions. Light bulb 248 is shown having glass bulb portion 250 and base portion 252. Also shown is filament portion 256 consisting of rigid wires 254 and filament 260. Bottom portion 252 of light bulb 248 consists of threaded electric contact 258 and bottom electric contact 262 separated from each other by glass insulating spacer 264. Bottom electric contact 262 is shown having numerous electrically conductive substantially spherical protrusions 266 extending in an outward direction from bottom electric contact 262. Also shown is light bulb socket 270 having metal contact portions 272 and 274 along with plastic housing portion 276. Metal contact portion 274 is shown having numerous electrically conductive substantially spherical protrusions 278 extending in an outward direction and in contact with bottom electric contact 272 of light bulb 248. Wire 280 is shown connected to metal contact portion 272 and supplies electric power to metal contact portion 272. Wire 282 is shown connected to metal contact portion 274 and supplies electric power to metal contact portion 274.

The above described light bulb is representative of an electrical contactor suitable for multiple connection and disconnection cycles resulting from rotary sliding pressure. The rotary motion is provided by screwing light bulb 248 into light bulb socket 270 and the sliding pressure results from bottom electric contact 262 rotating against metal contact portion 274 under the downward force. This downward force results from screwing light bulb 248 into light bulb socket 270.

Multiple parallel electrically conductive pathways are established between bottom electric contact 262 (which may be considered a first contacting surface) and metal contact portion 274 (which may be considered a second contacting surface) in the usual way by employing electrically conductive substantially spherical protrusions 266 and 278.

The above description illustrates multi-protrusion contactor geometry having improved conductivity across contacting electrical surfaces. As mentioned earlier, low voltage applications tend to present special issues involving contact resistance. Examples of this type of electrical connection are numerous and include the following:

1. low voltage push buttons used on computer keyboards, telephones including cellular telephones, remote controls, household appliances such as microwave ovens and the like, and consumer electronic goods such as DVD players.
2. Electrical switches used low voltage applications such as track lighting, automotive, marine, or other vehicle applications.
3. Electrical contactors found in relays.
4. Low voltage electrical connectors used to connect wires to each other, or other electrical contacting surfaces such as printed circuit boards and the like.
5. Relay contacts used in low voltage applications.
6. Electrical grounding connections.
7. Contactors used in battery charging and other applications such as sensors where establishing a narrow voltage range is important.

Of particular interest is the contact resistance between individual batteries and their connectors in numerous applications including the charging of one set of batteries with another set of batteries. Outlined below is a specific example that illustrates this point.

Standard battery holders such as the Radioshack 4D battery holder model # 270-389 employ light spring pressure to push several individual single cylindrical cell batteries together to form a pack. Because of this, individual batteries can be removed and added with relative ease. While effective for numerous applications, applications involving the use of numerous series strung cells to recharge other batteries present special problems. This may be particularly true when using these packs to charge on board batteries in electrical bicycles during travel on bumpy roads.

Outlined below is an experiment that was carried out by Fred Miekka (the inventor) to determine continuity issues involved with the use of series connected rechargeable alkaline batteries in extending the range of electric bicycles.

Twenty brand new Rayovac 713-2 1.5 volt D cell rechargeable alkaline batteries were placed into the Rayovac alkaline battery charger (model number PS3). All twenty batteries were brought up to full charge and connected in series using multiple Radioshack model # 270-389 battery holders. The pack was connected to the 24 volt lead acid battery pack of the electric bicycle using a series diode to prevent reverse charging effects.

Initial testing revealed that all twenty batteries were required (30 volts) in order to charge the 24 volt lead acid battery pack. Furthermore, connection instabilities between individual batteries was evident based on observed intermittent charging current between the auxiliary alkaline range extension batteries and the main pack. This significant over voltage was required to overcome contact resistance between individual cells and to force electricity into the 24 volt lead acid battery pack.

A total of 7 trips on relatively level ground 15 miles in length were used for the test. Even with the significant over voltages employed, charge current from the alkaline rechargeable batteries to the main lead acid battery pack was intermittent. This current averaged 0.20 amperes while the bicycle was at rest and 1.0 amperes during use.

It is quite evident from the above described example that poor electrical contact exists in battery packs employing large numbers of cells (20) connected in series. This poor electrical contact may result intermittent power failure during use. This may be especially true when using one set of batteries to charge another as the voltage difference between the charging batteries and the batteries receiving the charge tend to be quite small.

The use of one set of batteries to charge another is becoming more prevalent. For example, Cellboost manufactures disposable batteries for recharging cellular telephone batteries when other power sources are not available. Other examples include the use of alkaline battery packs to maintain charge in other rechargeable battery systems. In these applications, establishing good electrical continuity between individual cells and/or other connections may be of significant importance. Employing the electrically conductive multi-protrusion technology of the present invention may be of significant benefit in the above described applications.

Those skilled in the art will understand that the preceding exemplary embodiments of the present invention provide foundation for numerous alternatives and modifications. These other modifications are also within the scope of the limiting technology of the present invention. Accordingly, the present invention is not limited to that precisely shown and described herein but only to that outlined in the appended claims.

What is claimed is:

1. A sliding electrical contactor suitable for multiple connection and disconnection cycles comprising:

an electrically conductive first contacting surface;

an electrically conductive second contacting surface;

said electrically conductive first contacting surface having electrically conductive substantially spherical protrusions extending in an outward direction toward said electrically conductive second contacting surface and;

said electrically conductive first contacting surface having electrical contact with said second electrically conductive contacting surface, wherein at least one of said electrically conductive contacting surfaces has sufficient compression spring properties to establish multiple parallel electrically conductive pathways between said first electrically conductive contacting surface and said second electrically conductive contacting surface.

2. A sliding electrical contactor as recited in claim 1 wherein said electrically conductive second contacting surface has geometry providing electrically conductive matching concavities to said electrically conductive substantially spherical protrusions on said first contacting surface.

3. A sliding electrical contactor as recited in claim 1 wherein said electrically conductive second contacting surface has electrically conductive substantially spherical protrusions extending from said electrically conductive second contacting surface in an outward direction.

4. A sliding electrical contactor as recited in claim 3 wherein said electrically conductive substantially spherical protrusions on said electrically conductive first contacting surface interlock with said substantially spherical protrusions on said electrically conductive second contacting surface.

5. A sliding electrical contactor as recited in claim 3 wherein said electrically conductive substantially spherical protrusions on said electrically conductive first contacting surface are in direct contact with said substantially spherical protrusions on said electrically conductive second contacting surface.

6. A sliding electrical contactor as recited in claim 1 wherein said electrically conductive substantially spherical protrusions on said electrically conductive first contacting surface have a plurality of smaller electrically conductive substantially spherical protrusions extending in an outward direction toward said electrically conductive second contacting surface.

7. A sliding electrical contactor as recited in claim 6 wherein said plurality of smaller electrically conductive substantially spherical protrusions form a flat planar surface relative to said electrically conductive first contacting surface.

8. An electrical contactor suitable for multiple connection and disconnection cycles comprising:

an electrically conductive first contacting surface;

an electrically conductive second contacting surface;

said electrically conductive first contacting surface having electrically conductive substantially spherical protrusions extending in an outward direction toward said electrically conductive second contacting surface and;

said electrically conductive first contacting surface having electrical contact with said electrically conductive second contacting surface to provide multiple parallel electrically conductive pathways from said electrically conductive first contacting surface to said electrically conductive second contacting surface upon the application of downward stationary pressure.

9. An electrical contactor as recited in claim 8 wherein said electrically conductive second contacting surface has electrically conductive substantially spherical protrusions extending from said electrically conductive second contacting surface in an outward direction.

10. An electrical contactor as recited in claim 9 wherein said electrically conductive substantially spherical protrusions on said electrically conductive first contacting surface are in direct contact with said substantially spherical protrusions on said electrically conductive second contacting surface.

11. An electrical contactor as recited in claim 9 wherein said electrically conductive second contacting surface has a top surface geometry providing electrically conductive matching concavities to said electrically conductive substantially spherical protrusions on said first contacting surface.

12. An electrical contactor as recited in claim 8 wherein said electrically conductive substantially spherical protrusions on said electrically conductive first contacting surface have a plurality of smaller electrically conductive substantially spherical protrusions extending in an outward direction toward said electrically conductive second contact surface.

13. An electrical contactor as recited in claim 12 wherein said plurality of smaller electrically conductive substantially spherical protrusions form a flat planar surface relative to said electrically conductive first contacting surface.

14. An electrical contactor suitable for multiple connection and disconnection cycles comprising:

an electrically conductive first contacting surface;

an electrically conductive second contacting surface;

said electrically conductive first contacting surface having electrically conductive substantially spherical protrusions extending in an outward direction toward said electrically conductive second contacting surface and;

said electrically conductive first contacting surface having electrical contact with said electrically conductive second contacting surface to provide multiple parallel electrically conductive pathways to said first electrically conductive contacting surface upon the application of rotary sliding pressure.

15. An electrical contactor as recited in claim 14 wherein said electrically conductive second contacting surface has electrically conductive substantially spherical protrusions extending from said electrically conductive second contacting surface in an outward direction.

16. An electrical contactor as recited in claim 14 wherein said electrically conductive substantially spherical protrusions on said electrically conductive first contacting surface have a plurality of smaller electrically conductive substantially spherical protrusions extending in an outward direction toward said electrically conductive second contacting surface.

17. An electrical contactor as recited in claim 16 wherein said plurality of smaller electrical conductive substantially spherical protrusions form a flat planar surface relative to said electrically conductive first contacting surface.

* * * * *